US006570153B1

(12) United States Patent
Li et al.

(10) Patent No.: US 6,570,153 B1
(45) Date of Patent: May 27, 2003

(54) TANDEM MASS SPECTROMETRY USING A SINGLE QUADRUPOLE MASS ANALYZER

(75) Inventors: Gangqiang Li, Palo Alto, CA (US); Hongfeng Yin, San Jose, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 226 days.

(21) Appl. No.: 09/691,522

(22) Filed: Oct. 18, 2000

(51) Int. Cl.[7] ..... H01J 49/42
(52) U.S. Cl. ..... 250/292; 250/282
(58) Field of Search ..... 250/292, 282

(56) References Cited

U.S. PATENT DOCUMENTS

| | | | | | |
|---|---|---|---|---|---|
| 4,234,791 | A | | 11/1980 | Enke et al. | 250/281 |
| 4,755,670 | A | * | 7/1988 | Syka et al. | 250/292 |
| 4,851,669 | A | | 7/1989 | Aberth | 250/281 |
| 5,032,722 | A | | 7/1991 | Boesl et al. | 250/287 |
| 5,179,278 | A | * | 1/1993 | Douglas | 250/292 |
| 5,202,563 | A | | 4/1993 | Cotter et al. | 250/287 |
| 5,352,892 | A | * | 10/1994 | Mordehai et al. | 250/292 |
| 6,011,259 | A | | 1/2000 | Whitehouse et al. | 250/287 |
| 6,177,668 | B1 | * | 1/2001 | Hager | 250/282 |

OTHER PUBLICATIONS

R.A. Yost, et al., J. Am. Chem. Soc., 2274–2275 (1978); "Selected Ion Fragmentation with a Tandem Quadrupole Mass Spectrometer".

C. L. Fernandez–Metzler, et al., Drug Metab. Dispo., 27:32–40 (1999); "Rapid Liquid Chromatography with Tandem Mass Spectrometry–Based Screening Procedures for Studies on the Biotransformation of Drug Candidates".

J. D. Morrison, et al., Proc. 34th Annual Conf. Mass Spectrom. Allied Topics, 222–225 (1986); "The Design and Development of a Quinquequadrupole Mass Spectrometer".

F.H. Strobel, et al., J. Am. Soc. Mass Spectrom., 2:91–94 (1991); "Detection of Femtomole and Sub–femtomole Levels of Peptides by Tandem Magnetic Sector/Reflectron Time–of–Flight Mass Spectrometry and Matrix–Assisted Laser Desorption Ionization".

G.L. Glish, et al., Anal. Instrum., 16:191–206 (1987); "Improved Performance of a Tandem Quadrupole/Time–of–Flight Mass Spectrometer".

(List continued on next page.)

*Primary Examiner*—Jack Berman

(57) ABSTRACT

Apparatus and methods are disclosed for conducting procedures of tandem mass spectrometry using a single quadrupole mass analyzer. In one embodiment of the present invention a mass spectrometry apparatus comprises a single quadrupole mass analyzer having a first end opposite a second end. A source of charged particles is adjacent the first end of the quadrupole mass analyzer and a gate for controlling passage of charged particles is present between the source of charged particles and the first end. The apparatus further comprises a first element between the gate and the first end, a second element adjacent the second end, and a detector for detecting charged particles, or fragments thereof, exiting the quadrupole mass analyzer. In a method in accordance with the invention, charged particles from a source thereof are directed into the quadrupole mass analyzer to select charged particles by their mass to charge ratio. The selected charged particles are directed to a zone adjacent the quadrupole mass analyzer to subject the selected charged particles to collisional forces to form fragments thereof, which are temporarily stored in the zone. To separate the fragments, the fragments are directed from the zone into the quadrupole mass analyzer in a direction opposite to the direction of the charged particles introduced from the source. The fragments are then detected.

33 Claims, 1 Drawing Sheet

OTHER PUBLICATIONS

S.M. Michael, et al., Anal. Chem., 65: 2614–2620 (1993); "Detection of Electrospray Ionization Using a Quadrupole Ion Trap Storage/Reflectron Time–of–Flight Mass Spectrometer".

F.W. McLafferty, Science 214:280–287 (1981); "Tandem Mass Spectrometry".

R.W. Konrat and R.G. Cooks, Anal. Chem. 50:81A–92A (1978); "Direct Analysis of Mixtures by Mass Spectrometry".

F.W. McLafferty, "Tandem Mass Spectrometry" John Wiley and Sons: New York (1983) p. 1–10.

* cited by examiner

TANDEM MASS SPECTROMETRY USING A SINGLE QUADRUPOLE MASS ANALYZER

BACKGROUND OF THE INVENTION

1. Field of the Invention

This invention relates generally to apparatus and methods for performing mass spectrometric analyses of material samples and, in particular, to tandem mass spectrometers and mass spectrometric methods for detecting molecular ions and fragments of molecular ions.

Mass spectrometry is an analytical methodology used for qualitative and quantitative chemical analysis of materials and mixtures of materials. In mass spectrometry, a sample of a material to be analyzed called an analyte is broken into electrically charged particles of its constituent parts in an ion source. Once produced, the analyte particles are separated by the spectrometer based on their respective mass-to-charge ratios. The separated particles are then detected and a mass spectrum of the material is produced. The mass spectrum is analogous to a fingerprint of the sample material being analyzed. The mass spectrum provides information about the masses and, in some cases, quantities of the various analyte particles that make up the sample and to some extent molecular structure. In particular, mass spectrometry can be used to determine the molecular weights of molecules and molecular fragments of an analyte. Additionally, mass spectrometry is used to identify molecular structure and components that form the structure within the analyte based on the fragmentation pattern when the bonds of the molecules are dissociated. Mass spectrometry has proven to be a very powerful analytical tool in material science, chemistry and biology along with a number of other related fields.

For structure determination of large biomolecules, a technique called tandem mass spectrometry (often referred to as tandem MS or MS/MS) is particularly important and such an instrument was disclosed by R. A. Yost, et al., (1978) J. Am. Chem. Soc., page 2274. A conventional tandem mass spectrometer requires two mass analyzers in series. In a tandem mass spectrometer, certain molecular ions, or so-called parent ions or precursors created from a sample, are selected by the first mass analyzer. The precursors are sent into a collision cell which contains an inert gas (helium, nitrogen, argon or xenon, etc) of pressure in the range of about $10^{-1}$ to $10^{-3}$ torr. In the collision cell, precursors undergo collision with the inert gas and become fragmented based on collisional induced dissociation (CID). The fragment ions, or so-called daughter ions, are then analyzed by the second mass analyzer. Tandem MS provides structural information of the biomolecules by establishing relationship between the precursor ions and their fragmentation products. Tandem mass spectrometry in combination with fragmentation based on collisional induced dissociation has been successful for sequencing peptides, proteins, DNA's, RNA's and other biomolecules. Another proven application of tandem MS is in the study of drug metabolism pharmacokinetics (DMPK). A discussion of this technique can be found in a publication of Fernandez-Metzler, et al., *Drug Metab. Dispo.* (1999) 27:32. In such application, quantitation of the sample with high sensitivity and high dynamic range is achieved because most chemical interferences are eliminated by the first precursor selection.

Conventional tandem mass spectrometers have been developed using a combination of the same type of mass analyzers, such as tandem quadrupole MS developed by Morrison, et al., *Proc.* 34$^{th}$ *Annual Conf. Mass Spectrom. Allied Topics*, 1986, page 222, tandem magnetic field MS published by McLafferty (ed.) in "Tandem Mass Spectrometry," Wiley, New York (1983) and tandem time-of-flight MS (TOFMS) disclosed in U.S. Pat. Nos. 5,032,722 and 5,202,563. Other tandem mass spectrometers involve two different types of mass analyzers (hybrid tandem MS). Such instruments include, for instance, combinations of magnet field MS with TOFMS by Strobel, et al., *J. Am. Soc. Mass Spectrom.* (1991), 2:91–94, quadrupole MS with TOFMS (Q-TOF) by Glish, et al., *Anal. Instrum.* (1987), 16:191–206, and ion trap with TOFMS by Michael, et al., *Anal. Chem.* (1993) 65:2614–2620.

It should be noted that, in the prior art as mentioned above, a minimum number of two mass analyzers are required to perform tandem mass spectrometry operation. In some cases, more than two mass analyzers are needed. Discussions about the fundamental aspects of tandem mass spectrometry can also be found in more detail in McLafferty (1981) *Science* 214:280–287 and Kondrat and Cooks (1978) *Anal. Chem.* 50:81A–92A.

A molecule collision cell is an important part of a tandem mass spectrometer. In collisional induced dissociation (CID), a radio frequency (RF) multipole ion guide is often used as a collision cell. When molecular ions or precursors are sent into a RF multipole field, these ions are forced to oscillation due to alternated potential field inside the multipole. At the same time, the molecular ions or precursors collide with the background gas (normally a neutral inert gas), a portion of the translation energy of the ions converts into activation energy that is sufficiently high enough and certain molecular bonds are broken. In tandem MS, the multipole ion guide is placed between two mass spectrometers. The major functions of a collision cell are generation of desirable fragments from the complex molecular ions or precursors as well as to confine both the parent ions and their fragment daughters.

2. Brief Description of Related Art

U.S. Pat. No. 4,234,791 (Enke, et al.) discloses a tandem quadrupole mass spectrometer for selected ion fragmentation studies and low energy collision induced dissociator therefor.

U.S. Pat. No. 6,011,259 (Whitehouse, et al.) discusses multipole ion guide ion trap mass spectrometry with MS/MS$^N$ analysis.

SUMMARY OF THE INVENTION

One embodiment of the present invention is a mass spectrometry apparatus comprising a single quadrupole mass analyzer having a first end opposite a second end. A source of charged particles is adjacent the first end of the quadrupole mass analyzer and a gate for controlling passage of charged particles is present between the source of charged particles and the first end. The apparatus further comprises a first element between the gate and the first end, a second element adjacent the second end, and a detector for detecting charged particles, or fragments thereof, exiting the quadrupole mass analyzer.

Another embodiment of the present invention is a mass spectrometry apparatus comprising a single quadrupole mass analyzer having a first end opposite a second end. An ion source is adjacent the first end of the quadrupole mass analyzer and an ion gate is present between the ion source and the first end. The apparatus further comprises a first element between the ion gate and the first end, a second element adjacent the second end, and an ion detector for detecting ions, or fragments thereof, exiting the quadrupole mass analyzer.

Another embodiment of the present invention is a mass spectrometry apparatus comprising a single quadrupole mass analyzer having a first end opposite a second end, an ion source adjacent the first end, and an ion gate between the ion source and the first end. A first ion detector is adjacent the ion gate and offset with respect to the optical axis of the quadrupole mass analyzer. A second ion detector is adjacent the second end. An ion deflector lies between the ion source and the first end. The apparatus further comprises an element adapted to generate an oscillating field and two electrodes adjacent opposite ends of the element. Each of the electrodes is independently connected to a source of electrical activation.

Another embodiment of the present invention is a mass spectrometry apparatus comprising a single quadrupole mass analyzer having a first end opposite a second end. An ion source and a first set of electrodes are adjacent the first end. The electrodes are disposed with respect to each other to form a space therebetween. Each of the electrodes is independently adapted to receive a voltage. A second set of electrodes is adjacent the second end and disposed with respect to each other to form a space therebetween. Each of the elements is independently adapted to receive a voltage. The electrodes of the first set and the electrodes of the second set are substantially aligned with the optical axis of the quadrupole mass analyzer. The apparatus further includes an ion detector for detecting ions exiting the quadrupole mass analyzer.

Another embodiment of the present invention is a method for conducting tandem mass spectrometry using a single quadrupole analyzer. Charged particles from a source thereof are directed into the quadrupole mass analyzer to select charged particles by their mass to charge ratio. The selected charged particles are directed to a zone adjacent the quadrupole mass analyzer to subject the selected charged particles to collisional forces to form fragments thereof, which are temporarily stored in the zone. To separate the fragments, the fragments are directed from the zone into the quadrupole mass analyzer in a direction opposite to the direction of the charged particles introduced from a source thereof. The fragments are then detected.

Another embodiment of the present invention is a method for conducting tandem mass spectrometry using a single quadrupole analyzer. Charged particles from a source thereof are directed into the quadrupole mass analyzer to separate the charged particles by their mass to charge ratio. The separated charged particles are detected and one or more subsets of the separated charged particles are identified. The above procedure is repeated to generate the one or more subsets of the separated charged particles in the quadrupole mass analyzer. One or more subsets of the separated charged particles are directed to a zone adjacent the quadrupole mass analyzer. A neutral gas is introduced into the zone to subject the one or more subsets of the separated charged particles to collision to form fragments thereof, which are temporarily stored in the zone. New charged particles from the source are temporarily prevented from exiting the source. The fragments are directed from the zone into the quadrupole mass analyzer in a direction opposite to that in step (a) to separate the fragments, which are deflected and detected.

Another embodiment of the present invention is a method for conducting tandem mass spectrometry using a single quadrupole analyzer. Ions are formed in an ion source and directed into the quadrupole mass analyzer. Voltages are applied to the quadrupole mass analyzer to separate the ions according to their mass-to-charge ratio. The separated ions exiting the quadrupole mass analyzer are detected by means of a first detector. A subset of the separated ions is selected based on the detection. The above procedure is repeated to generate, in the quadrupole mass analyzer, ions corresponding to the subset. The subset is directed into the space between a set of electrodes adjacent the quadrupole mass analyzer wherein the electrodes are substantially aligned with the optical axis of the quadrupole mass analyzer. A neutral gas is introduced into the space and an oscillating field is created within the space to form fragments from the subset by means of ion-gas collision. The fragments are stored in the space. Then, ions are temporarily prevented from exiting the ion source or entering the quadrupole mass analyzer such as, for example, by applying an electrical voltage to an ion gate electrode adjacent the ion source. Electrical voltages are applied to the electrodes to direct the fragments through the quadrupole mass analyzer in a direction opposite to that in step (a) to separate the fragments. Next, electrical voltages are applied to a set of electrodes in the form of an ion deflector to deflect the fragments exiting the quadrupole mass analyzer into an ion detector. The fragments are detected by means of, for example, a second detector adjacent the ion source.

DETAILED DESCRIPTION OF THE INVENTION

Figure 1:
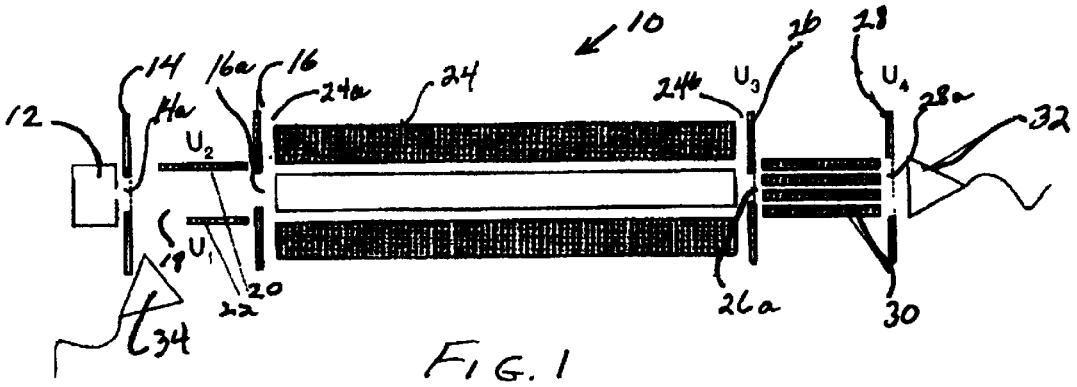
FIG. 1 is a diagrammatic sketch depicting one embodiment of an apparatus in accordance with the present invention.

The present invention provides methods and apparatus for carrying out the procedures or steps involved in tandem mass spectrometry using a single quadrupole mass analyzer. The apparatus of the present invention may be used to create charged species from a sample, select one individual species, fragment that species, and obtain the mass spectrum of the fragments. Unlike the tandem arrangement of the prior art that generally involves at least two quadrupole mass analyzers, the present apparatus utilize a single quadrupole mass analyzer. The apparatus further comprise all lenses and other components necessary for ion transportation and focusing as discussed herein. By appropriate adjustment of voltages applied to the various elements of the present apparatus, as well as adjustment of pressure within certain components, at predetermined times, charged particles may be generated, selected, fragmented and detected using a single quadrupole mass analyzer.

While the discussion herein is primarily directed to ion species for purposes of illustration, the invention has application to charged particles in general. Charged particles are those particles that exhibit an overall charge greater or less than neutral. Such charged particles include, for example, positively and negatively charged particles, singularly and multiply charged particles, atomic and molecular ions and fragments thereof, and the like. The term "ion species" includes both parent ions or molecular ions or precursors, i.e., ions generated by an ion source, and fragments of the parent ions otherwise referred to as daughter ions.

In comparison to known tandem mass spectrometers, the apparatus of the invention are less complex and have simpler construction requiring less complicated fabrication. Accordingly, the present devices have a lower cost of manufacture than that of the known tandem mass spectrometry apparatus. The components of the present apparatus can be made with a number of structural variations to achieve the advantages of tandem mass spectrometry using a single quadrupole mass analyzer. The apparatus of the present invention can be built by modifying existing commercial or laboratory-type non-tandem mass spectrometer utilizing a single quadrupole mass analyzer.

In accordance with the above, one embodiment of the present invention is a mass spectrometry apparatus comprising a single quadrupole mass analyzer. Quadrupole mass analyzers are well known in the art and generally comprise conventional components. The quadrupole mass analyzer employs a radio frequency (RF) potential such as U- Vcos ($\omega t$). Selecting a set of U, V and $\omega$ values allows only ions of a certain mass-to-charge ratio pass through the quadruple. In conventional operations, the value of $\omega$ is chosen as a constant while the ratio of U/V is varied to allow a sequence scanning of all ions. If both $\omega$ and U/V are set as constant, only ions of given mass-to-charge ratio is detected. This operation is referred to as single ion monitoring (SIM). In case the value of U is zero (RF-only quadrupole), ions of a wide range of mass-to-charge ratio can be simultaneously transmitted and quadrupole acts like an ion guide. Incorporating with an inert gas, quadrupole can be seen as a particular construction of aforementioned multipole collision cell. A detailed discussion of these components can be found in Quadrupole Mass Spectrometry and Its Applications, Dawson (ed), AIP Press, Woodbury, N.Y., 1995.

An ion source is adjacent a first end of the quadrupole mass analyzer. The ion source is usually a device for forming ions from a sample to be analyzed. The ion source may be any conventional component capable of ionizing, and in some cases accelerating and focusing, ions from gas, liquid or solid material samples. The ions may be formed into a collimated ion beam. Ion sources as a means for producing ions include, by way of illustration and not limitation, electrospray source, photoionization source, MALDI source, bombardment of a sample with an electron beam using ionization energy that may be continuous or pulsed, fast atom bombardment, liquid SIMS, chemical ionization such as, e.g., atmospheric pressure chemical ionization, field ionization, field desorption, inductively coupled plasma source and the like.

As mentioned above, the ion source is adjacent the first end of the quadrupole mass analyzer. Usually, the optical axis of the ion source is substantially coaxial or aligned with the optical axis of the quadrupole mass analyzer. It is well known that the transmission efficiency of quadrupole mass analyzer is highest if ions are sent through its optical axis. However, in some circumstances, to prevent unwanted neutral species or ions from entering the mass analyzer, the ion source is not optically aligned with the axis of the quadrupole. In such cases, some additional ion optical elements may be employed to guide the ion beam into the quadrupole mass analyzer. The aforementioned situation applies to other components of the present apparatus discussed below.

An ion gate is present between the ion source and the first end. The ion gate functions, at predetermined times, to prevent ions, usually newly generated ions, from entering the quadrupole mass analyzer or exiting the ion source. Generally, the optical axis of the ion gate is substantially coaxial with the optical axis of the quadrupole mass analyzer. An ion gate can be constructed using a planar electrode with an aperture in its center and arranged perpendicular to the optical axis of the quadrupole mass analyzer. This aperture may further be covered with high transparent metal grid material. If the potential applied to the ion gate is higher than the kinetic energy of the ion beam, no ion can enter the quadrupole mass analyzer and vice versa. Another embodiment of the ion gate is constructed using a pair of deflection plates arranged parallel to the optical axis. Applying a potential difference to the deflection plates generates a potential field perpendicular to the ion travel and hence removes ion beam from the optical axis. The ion gate can also be constructed by other means such as disclosed by Vlasak, et al., *Rev. Sci. Instrum.* (1996), 67:68.

The apparatus further comprises a first element between the ion gate and the first end of the quadrupole mass analyzer. The first element generally comprises at least one electrode. In one embodiment the first element comprises two electrodes each independently connected to a source of electrical activation. Each of the electrodes is substantially aligned parallel with the optical axis of the quadrupole mass analyzer. The two electrodes may comprise an ion deflector, i.e., the two electrodes may be ion deflection plates. Under appropriately applied voltages as discussed herein, the ion deflector functions to deflect ions exiting the quadrupole mass analyzer to a detector. Typical ion deflectors include parallel electrodes, electrostatic or magnetic fields and the like.

The apparatus may further comprise a beam limiting plate with an aperture. The aperture may further be covered with a metal grid material of high transparency. The beam limiting plate usually lies between the first element and the first end of the quadrupole mass analyzer. The plate is generally an electrode independently connected to a source of electrical activation. The axis of the aperture of the beam limiting plate is substantially aligned with the optical axis of the quadrupole mass analyzer. The beam limiting aperture functions to shield the first element from the quadrupole mass analyzer and reduce the level of noise in the apparatus. The beam limiting plate is of the type well known in the field of quadrupole mass spectroscopy.

The apparatus in accordance with the present invention further comprise a second element adjacent the second end of the quadrupole mass analyzer. The second element is aligned with the optical axis of the quadrupole mass analyzer. The second element usually comprises at least one electrode, which may be employed in conjunction with a second electrode or may be in the form of a ion collision/ion storage cell that is adapted to receive an oscillating electrical potential field. In the latter situation, the second element functions as an ion collision and/or an ion storage cell as explained more fully below. The ion collision/ion storage cell is adapted for introduction of a gas therein and further to control the pressure therein. Such adaptations are well known in the art and will not be discussed in more detail. Further discussion of such adaptations may be found in publication of Glish, et al., *Anal. Chem.* (1982), 54:842, the disclosure of which is incorporated herein by reference. In one embodiment the second element is a multipole ion guide connected to an RF voltage source. In general, the electrodes that comprise the second element may be independently connected to a source of electrical activation depending on the function of the second element.

In a specific embodiment the second element comprises an ion collision/ion storage cell and two electrodes adjacent opposite ends of the cell. The optical axis of each of the electrodes is substantially aligned with the optical axis of the quadrupole mass analyzer. Each of the electrodes is independently connected to a source of electrical activation. In this embodiment one of the electrodes is positioned between the second end of the quadrupole mass analyzer and the end of the ion collision/ion storage cell to which the electrode is adjacent. Such electrode may comprise a vacuum conducting aperture for creating a pressure difference between the regions separated by the electrode. Differential pumping may be applied to the different regions. And a gas inlet may be used to introduce a collision gas into ion collision/storage cell. The gas inlet may further be controlled to synchronize with ion selection and fragmentation/storage cycle.

The apparatus of the invention also comprise at least one ion detector for detecting ions, or fragments thereof, exiting the quadrupole mass analyzer. Ideally, the detector must have high sensitivity and wide dynamic range as well as providing good temporal resolution. A number of different detector types are used in mass spectrometers. Such detectors include, for example, the channeltron, Daly detector, electron multiplier tube, Faraday cup and microchannel plate. Recently, hybrid electron multiplier detectors have been developed. Hybrid electron multiplier detectors have generally been based on the combination of a micro channel plate MCP multiplier and a discrete dynode multiplier, the classic multi-dynode electron multiplier (EM).

The axis of the ion detector may be substantially aligned with the optical axis of the quadrupole mass analyzer. In certain embodiments of the present apparatus such as an embodiment wherein the apparatus comprises at least two detectors, the axis of one of the detectors may be offset from the optical axis of the quadrupole mass analyzer. This situation is particularly applicable where the detector that is offset is adapted to receive ions deflected from an ion deflector. It should be obvious that the amount of the offset is dependent, among others, on the nature of the ion detector, the ion deflector and the nature of ions to be detected, such as energy and mass-to-charge ratio. The magnitude of the deflection of the ions by the ion deflector is a significant factor in the magnitude of the offset for placement of the ion detector relative to the optical axis of the quadrupole mass analyzer.

Various embodiments of apparatus in accordance with the present invention will be described next, by way of example and not limitation, with reference to the appended drawings.

Referring to FIG. 1, apparatus 10 is depicted comprising single quadrupole mass analyzer 24, ion source 12, ion gate 14 with aperture 14*a* and beam limiting plate 16 with aperture 16*a*. Disposed between ion gate 14 and plate 16 is ion deflector 18 comprising ion deflection plates 20 and 22. Mass analyzer 24 has opposing ends 24*a* and 24*b*. Plate 16 lies adjacent end 24*a*. Adjacent to end 24*b* of mass analyzer 24 is a pair of electrodes 26 and 28. Electrode 26 has a vacuum conducting aperture 26*a* and electrode 28 has aperture 28*a*. Ion collision/ion storage cell 30 lies between electrodes 26 and 28. A first ion detector 32 is adjacent electrode 28 and a second ion detector 34 is adjacent ion gate 14. All of the above components are aligned with the optical axis of quadrupole mass analyzer 24 with the exception of second ion detector 34, which is offset from the optical axis. The offset of ion detector 34 permits detection of ions deflected by ion deflector 18.

Figure 3:
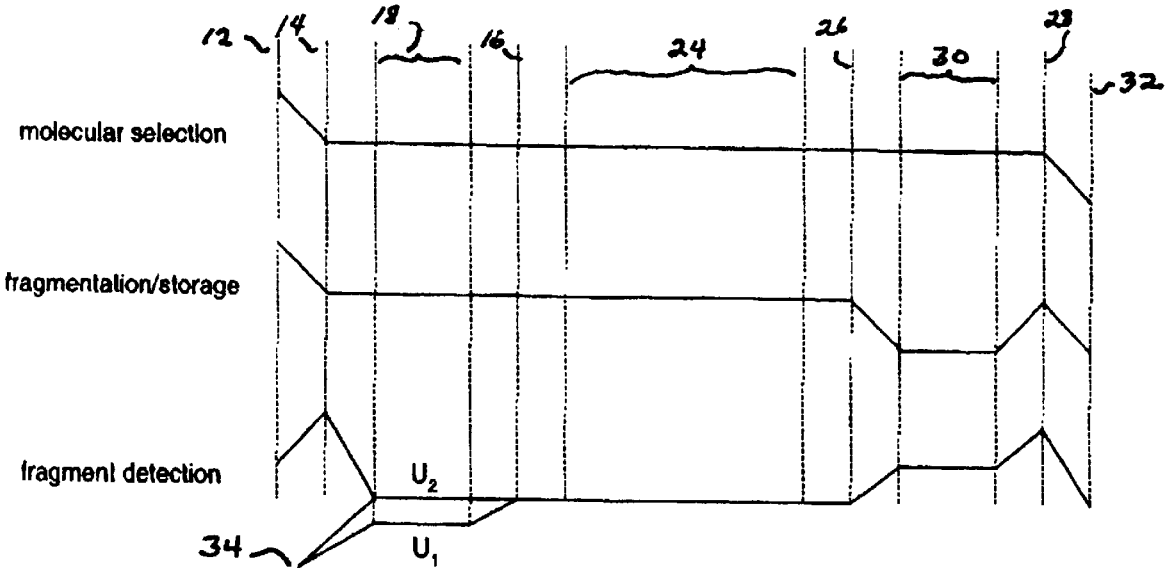
FIG. 3 is an example of a voltage guide for operation of the apparatus of FIG. 1. The horizontal axis depicts the relative position of the elements in FIG. 1 and the vertical axis depicts the voltages applied to these elements.

As mentioned above, the present methods are carried out using a single quadrupole mass analyzer. In the methods of the present invention, charged particles such as ions from a source thereof are directed into the quadrupole mass analyzer to select charged particles by their mass to charge ratio. This step is referred to in FIG. 3 as molecular selection. The selected charged particles are directed to a zone adjacent the quadrupole mass analyzer to subject the selected charged particles to collision to form fragments thereof, which are temporarily stored in the zone. This step is referred to in FIG. 3 as fragmentation/storage. To separate the fragments, the fragments are directed from the zone into the quadrupole mass analyzer in a direction opposite to the direction of the charged particles introduced from a source thereof. The fragments are then detected. In FIG. 3 this step is identified as fragment detection.

The above steps may be explained in more detail using ions as an example of charged particles and apparatus 10 of FIG. 1 as an example of an apparatus in accordance with the present invention. This is by way of illustration and not limitation. Referring to FIG. 1, ions are formed in ion source 12 and these ions are directed through ion gate 14, deflection plates 20 and 22 and beam limiting plate 16 into quadrupole mass analyzer 24. In general, as can be seen in FIG. 3, for the molecular selection stage, i.e., the selection of a subset of ions to study, the electrical potential or voltage on the ion source is higher than voltages on ion gate 14 and deflector 18, usually by 2 to 20 volts and more typically by 5 to 10 volts. Voltages on gate 14 and deflection plates 20 and 22 are set so as not to interfere with the passage of ions therethrough. In mass analyzer 24, radio frequency voltages are applied to the quadrupole to separate the ions according to mass-to-charge ratio. In this step quadrupole mass analyzer 24 functions in a conventional single ion monitoring (SIM) mode. The separated ions exiting quadrupole mass analyzer 24 are detected by means of ion detector 32. The ions are directed to detector 32 by virtue of a drop in electrical potential between quadrupole mass analyzer 24 and ion detector 32. The drop in electrical potential is usually about 500 volts to about 10000 volts, more usually, about 1500 volts to about 3000 volts. As a result of the above operation, a subset of the separated ions is selected for further study based on the detection. The subset is selected usually based on an assessment of the masses of the ions that are of most interest in carrying out the mass spectral analysis.

Once the subset of ions has been selected, the above procedure is repeated to generate, in the quadrupole mass analyzer, ions corresponding to the subset. The sample is ionized in ion source 12 and these ions are directed through ion gate 14, deflection plates 20 and 22 and beam limiting plate 16 into quadrupole mass analyzer 24. As in the previous steps, the electrical potential or voltage on the ion source is higher than voltages on ion gate 14 and deflector 18. In mass analyzer 24, the subset of ions is identified and directed into ion collision/ion storage cell 30. Referring to the fragmentation/storage step in FIG. 3, such fragmentation/storage is accomplished by altering the electrical potential or voltage $U_3$ on electrode 26 and $U_4$ on electrode 28 so that a potential well along the optical axis within cell 30 is created and the subset of ions are confined therein and subjected to dissociation resulting from ion collision. The electrical voltage applied to cell 30 generally is a DC voltage that is sufficient to accelerate molecular ions to a desirable energy for fragmentation purpose and to confine both the precursors and the fragment ions in cell 30. For collisional induced dissociation, the electrical potential in cell 30 is usually about 1 to about 1000 volts, more usually, about 10 to about 100 volts, different than the electrical potential for other components.

A neutral gas is introduced into cell 30 and an oscillating field is created within cell 30 to form fragments from the subset by means of ion collision. The neutral gas is typically nitrogen, argon, xenon and the like. The ions are introduced into cell 30 in the presence of a neutral gas. For example, the neutral gas may be introduced into cell 30 prior to introduction of the ions. In some circumstances, alternatively, the neutral gas is introduced into cell 30 together with the introduction of the ions into cell 30. Accordingly, cell 30 is adapted to be pressurized by introduction of the neutral gas. Such adaptations to introduce a gas into apparatus for mass spectrometry are well known in the art and will not be mentioned here. The pressure of the neutral gas is typically, about 1 to about $10^{-3}$ torr.

The voltages applied to generate the potential well include an oscillating component so that an oscillating electric potential field is generated sufficient to produce oscillation of the molecular ions in cell 30 so that the particles can undergo collisional induced dissociation. Collisional induced dissociation is a process governed by many molecular and instrumental parameters, as well as molecular structure. Generally, changes to parameters lead to changes in fragment patterns. One skilled in the art will be able to determine particular parameters for particular applications based on the disclosure herein and the knowledge of the art. The nature of the oscillating electric potential field created within cell 30 is related to the nature and magnitude of the electrical voltages applied to the electrodes. The nature of the electrical voltages may be, for example, oscillating (such as, e.g., radio frequent (RF) and the like), direct current (DC), ground and so forth and mixtures thereof. However, at least one of the voltages applied consists of an oscillating voltage component.

The fragments generated from the selected subset of ions are stored in cell 30 until they are to be subjected to analysis using the present apparatus. The period of storage is, in general, from several microseconds to several milliseconds. In the next step of the process and prior to directing the fragments into quadrupole mass analyzer 24 from cell 30, new ions from ion source 12 are temporarily prevented from exiting ion source 12 or entering quadrupole mass analyzer 24. This is accomplished in the embodiment of FIG. 1, for example, by altering the electrical potential of ion gate 14 such that any ions exiting ion source 12 are prevented from passing through ion gate 14 and entering mass analyzer 24. In general, the electrical potential applied to ion gate 14 is sufficient to prevent ions from entering end 24*a* of mass analyzer 24. This potential is, for instance, 10 to 100 volts higher than the potential of the ion source.

When new ions are prevented from passing through ion gate 14, the electrical potential or voltage $U_3$ on electrode 26 and $U_4$ on electrode 28 is altered so that the potential along the optical axis is such that the fragments are directed into end 24*b* of quadrupole mass analyzer 24 to separate the fragments, which travel in the direction of end 24*a* of mass analyzer 24. Referring to the fragment detection step in FIG. 3, it can be seen for this embodiment that the electrical potential $U_4$ on electrode 28 is raised and the electrical potential $U_3$ on electrode 26 is lowered so that the resulting potential within mass analyzer 24 is altered with respect to that in cell 30. As a result, fragments are accelerated into end 24*b* of mass analyzer 24 where fragments are subjected to separation. The alteration in potential between cell 30 and mass analyzer 24 to achieve this movement of the fragments is usually about 2 to about 100 volts, more usually, about 5 to about 10 volts. Quadrupole mass analyzer 24 is run in a conventional mode to separate the fragments introduced into end 24*b*. The pressure within mass analyzer for this step is typically about $10^{-4}$ to about $10^{-10}$ torr, more usually about $10^{-5}$ to about $10^{-7}$ torr.

Next, the electrical potential adjacent end 24*a* of mass analyzer 24 is altered to deflect the fragments exiting quadrupole mass analyzer 24 to ion detector 34. Referring to the fragment detection step in FIG. 3, the electrical potential on ion deflector 18 is altered by lowering the voltage $U_1$ applied to electrode 22 so that fragments are deflected to ion detector 34. The alteration in potential to achieve deflection of the fragments is dependent on a number of factors such as the magnitude of the offset of ion detector 34, the nature of the ions or fragments, such as ion energy and mass-to-charge ratio thereof. In this embodiment, electrostatic potential is used to deflect the fragment ions. However, in other situation, magnetic deflection field may be utilized.

The terms "applying voltages," "voltages applied" and "application of electrical voltages" and the like refer to the directing of electrical potential to elements of the present apparatus to produce a difference in electrical potential therebetween. The terms include the maintaining of one of the elements at ground and direction of electrical potential to the other element to produce a difference in electrical potential. It should be noted that voltages referred above may be expressed with respect to positive ions. For negative ions, voltages would be of opposite polarity, i.e., the signs of the voltages would be reversed from the corresponding values for positive ions. Accordingly, for example, alteration of electrical potential by raising the voltage on a component for positive ions may be achieved for negative ions by lowering the voltage.

The aforementioned steps are repeated so that spectra may be obtained for all fragments by means of a data collection system, which is in communication with apparatus 10.

Figure 2:
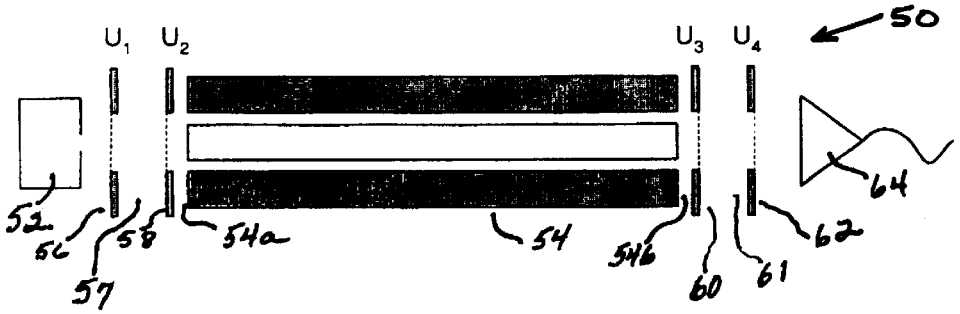
FIG. 2 is a diagrammatic sketch depicting another embodiment of an apparatus in accordance with the present invention.

Another embodiment of a mass spectrometry apparatus in accordance with the present invention is depicted in FIG. 2. Apparatus 50 comprises a single quadrupole mass analyzer 54 having a first end 54*a* opposite a second end 54*b*. Ion source 52 is adjacent end 54*a* of quadrupole mass analyzer 54. A set of electrodes, 56 and 58, lie between ion source 52 and end 54*a*. The axis of ion source 52 and electrodes 56 and 58 is substantially aligned with the optical axis of mass analyzer 54. Electrodes 56 and 58 are disposed with respect to each other to form space 57 therebetween. Generally, space 57 is sufficient to confine ions or fragments thereof within the space. Each of the electrodes is independently adapted to receive a voltage. A second set of electrodes, 60 and 62, is adjacent end 54*b* of quadrupole mass analyzer 54. Electrodes 60 and 62 are disposed with respect to each other to form space 61 therebetween. Generally, space 61 is sufficient to confine ions or fragments thereof within the space.

Each of the electrodes is independently adapted to receive a voltage. The electrodes of the first set and the electrodes of the second set are substantially aligned with the optical axis of quadrupole mass analyzer 54. Furthermore, each of the electrodes has a central aperture and each is preferably a ring-shaped electrode. The apertures may further be covered with highly transparent metal mesh. The transmission of the metal mesh is usually 80 to 95%. The apparatus further includes ion detector 64 for detecting ions exiting quadrupole mass analyzer 54. The axis of ion detector 64 is substantially aligned with the optical axis of quadrupole mass analyzer 54.

Apparatus 50 may be employed in one embodiment of a method in accordance with the present invention. Table 1 summarizes the operating modes of apparatus 50 and corresponding relative potentials on $U_1$, $U_2$, $U_3$ and $U_4$. In step 1, the molecular ion selection step, the voltages of all the electrodes 56, 58, 60 and 62 are switched to low so all the ions generated from ion source 52 can pass through the mesh of the electrodes, and quadrupole mass analyzer 54 functions as a conventional mass filter scanning ions by their mass to charge ratio. The voltages may be about 5 to 20 volts lower than the voltage applied to the ion source. The ions may be generated in a vacuum or in atmospheric pressure and so forth and then transmitted into a vacuum. In this step the ions travel into end 54*a* toward end 54*b*.

In step 2, the parent ion selection and storage mode, once the mass to charge ratio of the molecular ion of interest is determined, quadrupole mass analyzer 54 is switched to the single ion monitoring mode. In this mode only the selected mass ions can pass through quadrupole mass analyzer 54. The voltages $U_1$, $U_2$ and $U_3$ are held at low and $U_4$ is set at high. The electrical potential of electrode 62 should be at least sufficiently high enough so that it is higher than the kinetic energy of the ions and no ions reach the detector. While the potential on electrode 62 is held at high, the molecular ions are slowed down by the potential field generated by $U_3$ and $U_4$ and hence are stored in space 61. The molecular ions can be accumulated until the number of ions reaches the capacity of the storage limited by space charge.

In step 3, the parent ion fragmentation step, ions are fragmented by collisional induced dissociation. Due to the potential field between electrodes 60 and 62, the molecular ions reverse their direction and begin to travel through quadrupole mass analyzer 54 towards electrodes 56 and 58. Quadrupole mass analyzer 54 is switched to collision mode, i.e. only radio frequency (RF) potential is applied to the quadrupole. In this step, quadrupole mass analyzer acts like a multipole collision cell. Potential applied to the quadrupole is sufficient to produce ion oscillation for collisional dissociation purpose and to confine both precursors and fragment ions. Neutral gas is introduced into the region so that the molecular ions undergo collision with the gas and become fragmented. The fragments travel further towards electrodes 56 and 58.

In step 4, the fragment storage step, subsequent to fragmentation, the voltage $U_1$, is switched to high so a retarding field is generated between electrodes 56 and 58. The fragments enter space 57 between electrodes 56 and 58 and are slowed down and stored in space 57. The electrical potential of electrode 56 should be at least sufficiently high enough so that the ions are slowed sufficiently to be stored in space 57 and at the same time to prevent ions generated in the ion source from entering the mass analyzer 54. The latter function is similar to the function of ion gate 14 in the embodiment depicted in FIG. 1. The voltage $U_1$, is held at high until all the fragments are accumulated.

In step 5, the fragment ion detection, due to the higher voltage on electrode 56, the fragments reverse direction and travel through quadrupole mass analyzer 54 towards electrodes 60 and 62. Quadrupole mass analyzer 54 is switched to either the normal scanning mode to generate a complete spectrum for the fragments or to the single ion monitoring to detect a particular fragment ion mass. Voltages on electrodes 60 and 62 are held sufficiently low so that fragments can pass through the electrodes and be detected by ion detector 64.

The aforementioned steps are repeated so that spectra may be obtained for all fragments by means of a data collection system, which is in communication with apparatus 50.

TABLE 1

| Step | Operation of analyzer 54 | Potential | | | |
|---|---|---|---|---|---|
| | | $U_1$ | $U_2$ | $U_3$ | $U_4$ |
| 1. Molecular ion selection | Scanning or single ion monitoring | Low | Low | Low | Low |
| 2. Parent ion storage | Single ion monitoring | Low | Low | Low | High |
| 3. Parent ion fragmentation | Ion guide for collision dissociation | High | Low | Low | High |
| 4. Fragment storage | Ion guide for collision dissociation | High | Low | Low | High |
| 5. Fragment ion detection | Scanning or single ion monitoring | High | Low | Low | Low |

All publications and patent applications cited in this specification are herein incorporated by reference as if each individual publication or patent application were specifically and individually indicated to be incorporated by reference.

Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

What is claimed is:

1. A mass spectrometry apparatus comprising:

(a) a single quadrupole mass analyzer having a first end opposite a second end, (b) a source of charged particles adjacent said first end of said quadrupole mass analyzer, (c) an ion gate between said source of charged particles and said first end, (d) a first element between said ion gate and said first end, said first element comprising a deflector for deflecting charged particles, (e) a second element adjacent said second end, and (f) a detector for detecting charged particles or fragments thereof exiting said quadrupole mass analyzer.

2. An apparatus according to claim 1 further comprising a beam limiting plate with an aperture, said beam limiting plate being adjacent said first end.

3. An apparatus according to claim 1 wherein said second element is adapted to generate an oscillating field.

4. An apparatus according to claim 1 further comprising two electrodes adjacent opposite ends of said second element, each of said electrodes being independently connected to a source of electrical activation.

5. An apparatus according to claim 4 wherein said second element is connected to an Rf voltage source.

6. An apparatus according to claim 5 wherein one of said electrodes comprises a vacuum conducting aperture adjacent said second end.

7. An apparatus according to claim 1 wherein said source of charged particles is an ion source, said deflector for deflecting said charged particles is an ion deflector and said detector for detecting charged particles is an ion detector.

8. A mass spectrometry apparatus comprising:

(a) a single quadrupole mass analyzer having a first end opposite a second end, (b) a source of charged particles adjacent said first end of said quadrupole mass analyzer, (c) an ion gate between said source of charged particles and said first end, (d) a first element between said ion gate and said first end, said first element comprising two electrodes each independently connected to a source of electrical activation wherein said electrodes are aligned with the optical axis of said quadrupole mass analyzer, (e) a second element adjacent said second end, and (f) a detector for detecting charged particles or fragments thereof exiting said quadrupole mass analyzer.

9. An apparatus according to claim 8 wherein said source of charged particles is an ion source and said detector for detecting charged particles is an ion detector.

10. A mass spectrometry apparatus comprising:

(a) a single quadrupole mass analyzer having a first end opposite a second end, (b) a source of charged particles adjacent said first end of said quadrupole mass analyzer, (c) an ion gate between said source of charged particles and said first end, (d) a first element between said ion gate and said first end, (e) a second element adjacent said second end, (f) a first detector for detecting charged particles or fragments thereof exiting said quadrupole mass analyzer, and (g) a second detector for detecting charged particles wherein said first detector and said second detector are adjacent opposite ends of said quadrupole mass analyzer.

11. An apparatus according to claim 10 wherein said source of charged particles is an ion source and said first detector for detecting charged particles is an ion detector and wherein said second detector for detecting charged particles is an ion detector.

12. A mass spectrometry apparatus comprising:

(a) a single quadrupole mass analyzer having a first end opposite a second end, (b) an ion source adjacent said first end, (c) an ion gate between said ion source and said first end, (d) a first ion detector adjacent said ion gate and offset with respect to the optical axis of said quadrupole mass analyzer, (e) an ion deflector between said ion source and said first end, (f) an element adapted to generate an oscillating field, (g) two electrodes adjacent opposite ends of said element, each of said electrodes being independently connected to a source of electrical activation, and (h) a second ion detector adjacent said second end.

13. An apparatus according to claim 12 further comprising a beam limiting aperture between said ion deflector and said first end.

14. An apparatus according to claim 12 wherein said element is connected to an Rf voltage source.

15. An apparatus according to claim 12 wherein one of said electrodes comprises a vacuum conducting aperture and is disposed between said second end of said quadrupole mass analyzer and an end of said element.

16. An apparatus according to claim 12 wherein a pressure differential is present between said quadrupole mass analyzer and said element.

17. A mass spectrometry apparatus comprising:

(a) a single quadrupole mass analyzer having a first end opposite a second end, (b) an ion source adjacent said first end, (c) a first set of electrodes adjacent said first end and disposed with respect to each other to form a space therebetween, each of said electrodes being independently adapted to receive a voltage, (d) a second set of electrodes adjacent said second end and disposed with respect to each other to form a space therebetween, each of said electrodes being independently adapted to receive a voltage, and (e) an ion detector for detecting ions exiting said quadrupole mass analyzer, wherein said electrodes of said first set and said electrodes of said second set are substantially aligned with the optical axis of said quadrupole mass analyzer.

18. An apparatus according to claim 17 wherein each of said electrodes of said first set and said second set comprise a plurality of openings in the form of a grid.

19. A method for conducting the procedures of tandem mass spectrometry using a single quadrupole analyzer, said method comprising:

(a) directing charged particles from a source thereof into said quadrupole mass analyzer to select charged particles by their mass to charge ratio, (b) directing said selected charged particles to a zone adjacent said quadrupole mass analyzer to subject said selected charged particles to collision to form fragments thereof, (c) temporarily storing said fragments in said zone, (d) directing said fragments from said zone into said quadrupole mass analyzer in a direction opposite to that in step (a) to separate said fragments, and (e) detecting said fragments.

20. A method according to claim 19 wherein said charged particles are ions.

21. A method according to claim 19 wherein said fragments exiting said quadrupole mass analyzer in step (d) are directed back through said quadrupole mass analyzer to a detector.

22. A method according to claim 21 wherein said fragments exiting said quadrupole mass analyzer in step (d) are deflected to a detector.

23. A method according to claim 21 wherein step (d) further comprises temporarily preventing ions from said ion source from exiting said ion source.

24. A method according to claim 23 wherein said charged particles are ions.

25. A method for conducting the procedures of tandem mass spectrometry using a single quadrupole mass analyzer, said method comprising:

(a) directing charged particles from a source thereof into said quadrupole mass analyzer to separate said charged particles by their mass to charge ratio, (b) detecting said separated charged particles and identifying one or more subsets of said separated charged particles, (c) repeating step (a) to generate said one or more subsets of said separated charged particles in said quadrupole mass analyzer, (d) directing said one or more subsets of said separated charged particles to a zone adjacent said quadrupole mass analyzer, (e) introducing a neutral gas into said zone to subject said one or more subsets of said separated charged particles to collision to form fragments thereof, (f) temporarily storing said fragments in said zone, (g) temporarily preventing charged particles from exiting said source thereof, (h) directing said fragments from said zone into said quadrupole mass analyzer in a direction opposite to that in step (a) to separate said fragments, (i) deflecting said fragments exiting said quadrupole mass analyzer and detecting said fragments.

26. A method for conducting the procedures of tandem mass spectrometry using a single quadrupole analyzer, said method comprising:

(a) forming ions in an ion source, (b) directing said ions into said quadrupole mass analyzer and applying voltages thereto to separate said ions according to mass to charge ratio, (c) detecting said separated ions exiting said quadrupole mass analyzer by means of a first detector, (d) selecting a subset of said separated ions based on said detection, (e) repeating step (a) to generate said subset and directing said subset into said quadrupole mass analyzer, (f) directing said subset into a space between a set of electrodes adjacent said quadrupole mass analyzer wherein said electrodes are substantially aligned with the optical axis of said quadrupole mass analyzer, (g) introducing a neutral gas into said space and creating an oscillating field within said space to form fragments from said subset by means of ion collision, (h) storing said fragments in said space, (i) temporarily preventing ions from said ion source to exit said ion source by applying an electrical voltage to an ion gate electrode adjacent said ion source, (j) applying electrical voltages to said electrodes to direct said fragments through said quadrupole mass analyzer in a direction opposite to that in step (a) to separate said fragments, (k) applying electrical voltages to a set of electrodes in the form of an ion deflector to deflect said fragments exiting said quadrupole mass analyzer into an ion detector, and (l) detecting said fragments by means of a second detector adjacent said ion source.

27. A method according to claim 26 wherein said space between said set of electrodes comprises an element connected to an Rf voltage source.

28. A method according to claim 26 wherein said ions from said ion source are directed to a beam limiting aperture prior to entering said quadrupole mass analyzer.

29. A method according to claim 26 wherein in step (c) the electrical potential adjacent said detector is altered to direct said separated ions into said first detector.

30. A method according to claim 26 wherein said ions are stored in said space by creating a potential well between said two electrodes.

31. A method according to claim 26 wherein in step (j) the electrical voltage at the electrode distal to an opening of said quadrupole mass analyzer and the electrical voltage at the electrode proximate said opening are such as to create a voltage differential to accelerate said ions.

32. A method according to claim 26 wherein in steps (g) through (j) the pressure in said space is higher than the pressure in said quadrupole mass analyzer.

33. A method according to claim 26 wherein said ion gate is set at a potential that prevents ions from entering said ion gate.

* * * * *